US011346587B2

(12) United States Patent
Martin

(10) Patent No.: US 11,346,587 B2
(45) Date of Patent: May 31, 2022

(54) REFRIGERATION HEAT EXCHANGERS WITH EMBEDDED FINS

(71) Applicant: Heatcraft Refrigeration Products LLC, Richardson, TX (US)

(72) Inventor: Nicole Z. Martin, Marietta, GA (US)

(73) Assignee: Heatcraft Refrigeration Products LLC, Richardson, TX (US)

( * ) Notice: Subject to any disclaimer, the term of this patent is extended or adjusted under 35 U.S.C. 154(b) by 194 days.

(21) Appl. No.: 16/537,477

(22) Filed: Aug. 9, 2019

(65) Prior Publication Data

US 2021/0041149 A1 Feb. 11, 2021

(51) Int. Cl.

| | |
|---|---|
| ***F25B 1/10*** | (2006.01) |
| ***F25B 39/00*** | (2006.01) |
| ***F28F 1/32*** | (2006.01) |
| *F25B 39/04* | (2006.01) |

(52) U.S. Cl.

CPC ..... *F25B 39/00* (2013.01); *F28F 1/325* (2013.01); *F25B 39/04* (2013.01)

(58) Field of Classification Search

CPC ... F25B 39/00; F25B 39/04; F28F 1/24; F28F 1/32; F28F 1/325; F28F 1/30; F28F 1/34; F28F 1/22; F28F 1/26; F28F 1/36; F28F 1/28; F28F 2215/04; F28F 2009/226; F28F 9/013

USPC ..... 62/498

See application file for complete search history.

(56) References Cited

U.S. PATENT DOCUMENTS

| | | | | |
|---|---|---|---|---|
| 2005/0072562 | A1* | 4/2005 | Hall | F28F 21/082 165/182 |
| 2014/0262188 | A1* | 9/2014 | Sistla | F28F 1/32 165/182 |
| 2018/0299171 | A1* | 10/2018 | Olsen | F28F 9/0229 |
| 2020/0355412 | A1* | 11/2020 | Wang | F28D 1/05316 |

* cited by examiner

*Primary Examiner* — Henry T Crenshaw
*Assistant Examiner* — Kamran Tavakoldavani
(74) *Attorney, Agent, or Firm* — Johnston IP Law, PLLC

(57) ABSTRACT

In a refrigeration system, a tube-and-fin heat exchanger has spaced fins that extend to an outer periphery of the heat exchanger and has smaller embedded fins in between or in a spaced relationship with each of the other fins. The embedded fins do not extend all the way to the outer periphery of the fins along the airside directions but have a shorter outer periphery such that there is an offset distance. Because of the offset distance, there is space that continues to provide room for fluid movement without fouling of the face of the heat exchanger and that provides an expected appearance while still having the benefit of additional fins elements further inside of the heat exchanger. Other exchangers and condensers are included.

21 Claims, 9 Drawing Sheets

REFRIGERATION HEAT EXCHANGERS WITH EMBEDDED FINS

FIELD

This application is directed, in general, to refrigeration systems, and more specifically, to refrigeration tube-and-fine heat exchangers with embedded fins.

BACKGROUND

Refrigeration systems and HVAC systems require heat to be moved from one space to another. In these types of systems, heat exchangers are used. One type of heat exchanger is a tube-and-fin heat exchanger, or finned-tube heat exchangers. Tube-and-fin heat exchangers have tubes with extended surface area created by fins attached to the tubes. The tubes carry refrigerant therein, and the fins on the outside of the tubes along with the surface area of the tubes help provide heat exchange. The fins increase the effective heat transfer area between tubes and the surrounding fluid, e.g., air. At the same, clogging or fouling of the area between the tubes can be an issue and will compromise top performance of the heat exchanger.

SUMMARY

According to one illustrative embodiment, a refrigeration system includes a compressor and a condenser fluidly coupled to the compressor. The refrigeration system further includes an expansion valve fluidly coupled to the condenser and an evaporator fluidly coupled to the expansion valve. The compressor, the condenser, the expansion valve, and the evaporator form a closed fluid path.

The condenser includes a tube-and-fin heat exchanger having a plurality of tubes for receiving a refrigerant from the compressor and a plurality of fins coupled to the plurality of tubes and having an outer peripheral edge. The condenser further includes a plurality of embedded fins coupled to the plurality of tubes and having an outer peripheral edge. The outer peripheral edge of the plurality of embedded fins is inboard of the outer peripheral edge of the plurality of fins in at least some directions so as to provide clearance between the fins at a coil face.

According to an illustrative embodiment, a tube-and-fin heat exchanger for use in a refrigeration system includes a plurality of tubes and a plurality of fins coupled to the plurality of tubes and having an outer peripheral edge. The tube-and-fin heat exchanger further includes a plurality of embedded fins coupled to the plurality of tubes and having an outer peripheral edge. The outer peripheral edge of the plurality of embedded fins is inboard of the outer peripheral edge of the plurality of fins at least for the airside direction.

According to an illustrative embodiment, a method of manufacturing a tube-and-fin heat exchanger for use in a refrigeration system or other system includes providing a plurality of fins having a lateral width W1 and having a first plurality of apertures and includes providing a plurality of embedded fins having a lateral width W2. W2 is less than 95% of W1. The embedded fins have a second plurality of apertures. The method further includes providing a plurality of tubes. The first plurality of apertures and second plurality of apertures are sized and configured to have the plurality of tubes 304 inserted into the first plurality of apertures and the second plurality of apertures 336 and that is done. The method also involves attaching the plurality of fins and the plurality of embedded fins in an alternating fashion on the tubes.

According to an illustrative embodiment, a tube-and-fin heat exchanger has spaced fins that extend to an outer periphery of the heat exchanger, or coil face, and has smaller embedded fins in between each of the other fins. The embedded fins do not extend all the way to the outer periphery of the fins at least for the airside direction but have a shorter outer periphery such that there is an offset distance at least on the airside direction. Because of the offset distance, there is space that continues to provide room for fluid movement without fouling on the coil face of the heat exchanger and provides an expected appearance while still having the benefit of additional fins elements further inside of the heat exchanger. The smaller embedded fins may take the shape of long members that are connected together to form a single piece for ease of manufacture, a plate, or individual discs of various possible shapes. Other systems and methods and aspects are disclosed below.

BRIEF DESCRIPTION

Illustrative embodiments of the present invention are described in detail below with reference to the attached drawing figures, which are incorporated by reference herein and wherein.

DETAILED DESCRIPTION

Tube-and-fin heat exchangers are used in a wide variety of refrigeration and heating, ventilation, and air conditioning applications. Tube-and-fin heat exchangers typically have a plurality of spaced parallel tubes that carry a refrigerant or working fluid while a second fluid, such as air, is directed across the tubes. Fins are attached to the tubes to enhance heat transfer. The fins may take the form of thin sheets of metal that are placed on the tubes.

One of the issues that has to be addressed in designing or maintaining refrigeration or HVAC systems that include tube-and-fin heat exchangers is fouling. Fouling of the space between fins and around tubes may happen. The fouling may occur because of accumulation of dirt, fiber, debris, or other contaminants. It has been suggested that this is particularly an issue at the face of the coil where fibers tend to bridge between the respective leading edges of neighboring fins possibly causing blockage of air flow around the fins and tubes. Because of this alleged issue, users and purchasers of equipment often want the space between neighboring fins to be quite large relatively and tend to resist designs calling for closer spacing.

According to one illustrative embodiment, the primary lateral fins on a tube-and-fin heat exchanger continue to have legacy, or normal, spacing for a particular application, e.g., 10 fins per inch or less, but embedded fins—offset inwardly from the outer edge—are applied to the tubes. In this way, the effective fins per inch is increased but the spacing of the fins at the coil face is unchanged. The appearance will provide more confidence to users, and, may avoid fouling at the outer coil face.

For context, in refrigeration, heat is moved around in advantageous ways—usually from a cold space to a hot space. Heat exchangers are used in moving the heat. Again, one heat exchanger type uses tubes in which refrigerant flows and fins that are attached or put on the tubes that interact with the air or gas around. These heat exchangers are referred to as finned tube exchangers or tube-and-fin heat exchangers. As air or another fluid is moved across the fins, it helps the heat go from the tube into the fin or from the fin into the tube. These heat exchangers may be on the hot side, e.g., in the condenser, or on the cold side. An example of an application is shown in FIG. 1, which presents a condenser unit 100 for use in a refrigeration system as will be presented.

Figure 1:
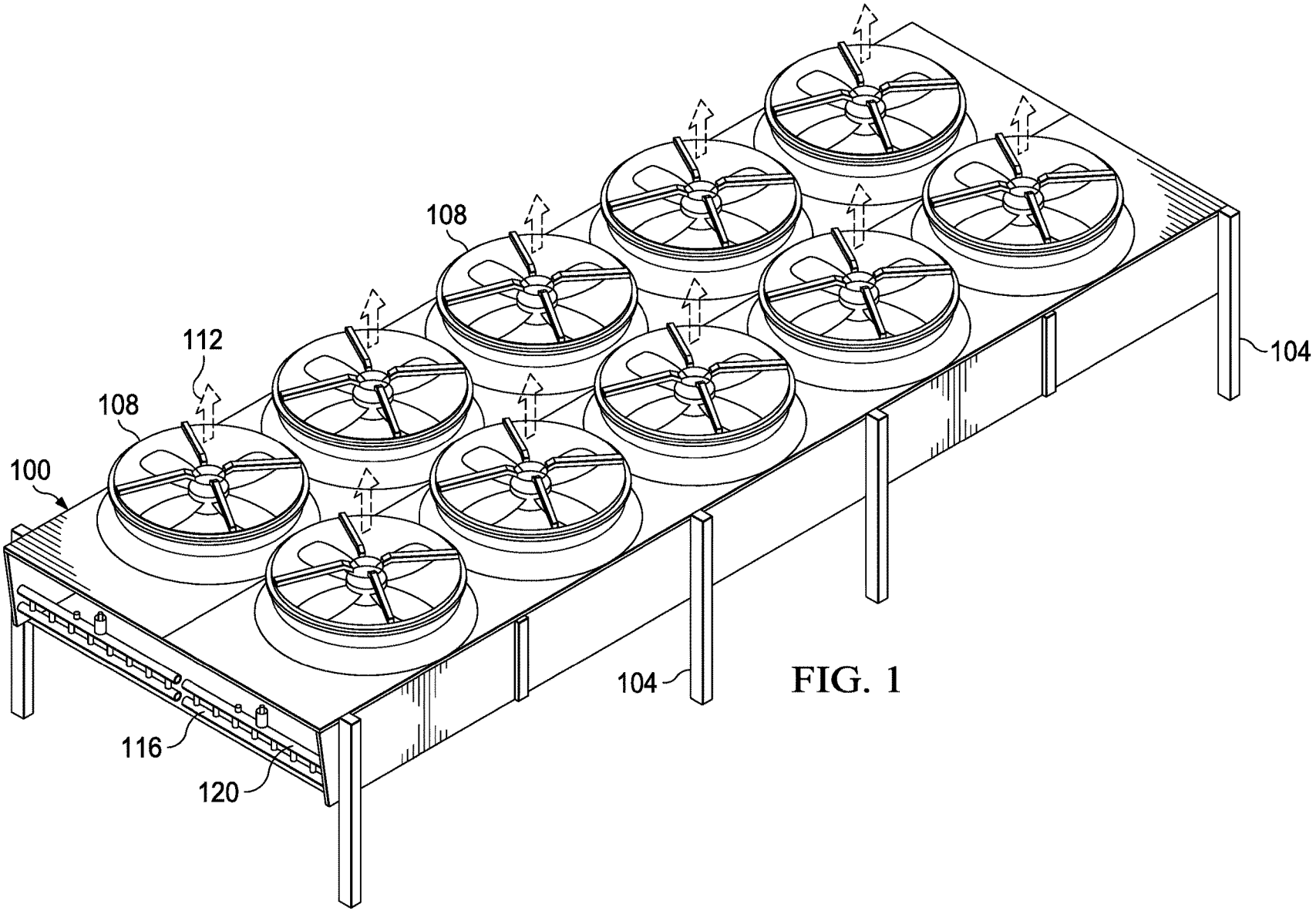
FIG. 1 is a schematic perspective view of an illustrative embodiment of a condenser unit having a tube-and-fin heat exchanger.
Figure 2:
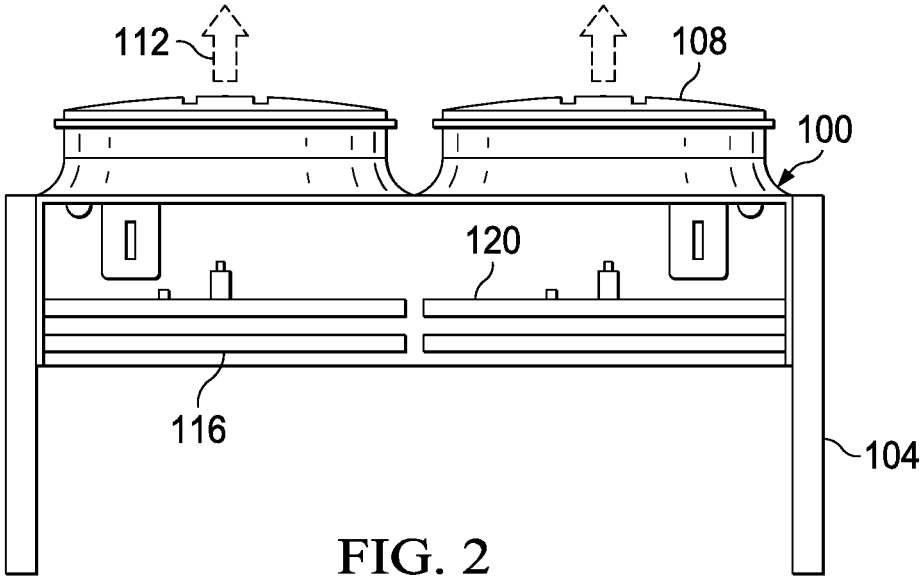
FIG. 2 is a schematic end elevation view of the condenser of FIG. 1.

Referring now primarily to FIGS. 1 and 2, an illustrative embodiment of the condenser unit 100 is shown. The condenser 100 may be used with a refrigeration system (e.g., 200 in FIG. 3) for a grocery store or other location. The condenser unit 100 may be supported using legs 104 on a rooftop or other surface. A plurality of fans, or air handlers 108, may be used to move air upward as shown by arrow 112.

That movement of air pulls air through a bottom portion (for orientation shown) and across a tube-and-fin heat exchanger 116, which together may be referred to as a coil. Refrigerant may be delivered and received through a number of manifolds 120. The tube-and-fin heat exchanger 116 has a face that is where the air or other fluid initially crosses the fins. As previously noted, the coil face is where it is said fouling will occur because debris or other items being pulled into the space between the fins on the face. Accordingly, some users become concerned about the spacing of fins becoming too small on the face. The condenser 100 of the present embodiment addresses this by keeping the outer fins or main fins separated at the face but has additional fin elements, or embedded fins, further inward in the coil to enhance heat exchange while avoiding closer fins on an outer periphery as will be explained further below.

As previously noted, the enhanced heat exchangers and systems herein are used as an aspect of or involve a refrigeration system. For example, an illustrative heat exchanger may be included as a condenser in a refrigeration system 200 as shown in FIG. 3 as will now be explained.

Figure 3:
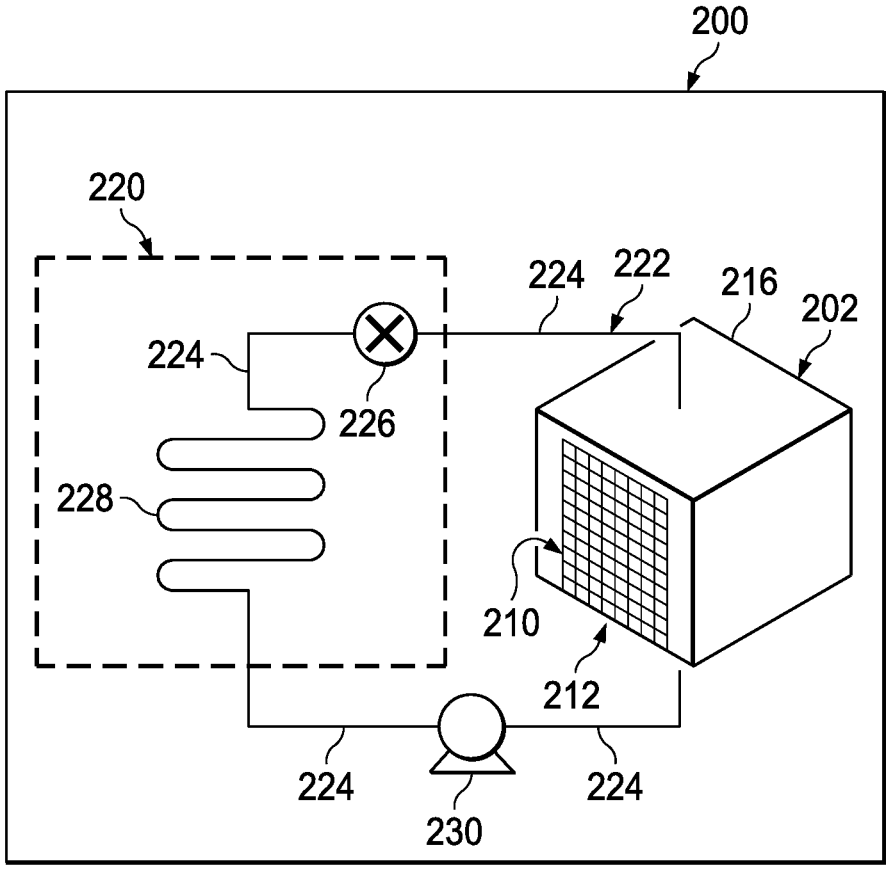
FIG. 3 is a schematic diagram of an illustrative embodiment of a refrigeration system or HVAC system.

Referring now primarily to FIG. 3, a schematic diagram of refrigeration system 200, or a heating ventilation and cooling (HVAC) system, is presented. The refrigeration system 200 may be used to cool a climate-controlled area, or a refrigerated space 220, which may include a refrigerator, cooler, building or the like. The refrigeration system 200 includes a closed refrigeration circuit 222 having a plurality of fluidly coupled conduits 224 connecting various components of the closed refrigeration circuit 222.

The closed refrigeration circuit 222 further includes a condenser 216 (see, also, e.g., 100 in FIG. 1) fluidly coupled to the plurality of conduits 224, an expansion device 226 fluidly coupled to the plurality of conduits 224, an evaporator 228 fluidly coupled to the plurality of conduits 224, and a compressor 230 fluidly coupled to the plurality of conduits 224. The compressor 230 is shown separate from the condenser housing unit 202, but is at times located within the condenser housing unit 202. A refrigerant flows through the closed refrigeration circuit 222 in a circuit as a working fluid. The refrigerant may include conventional refrigerants such as hydrofluorocarbons, carbon dioxide or other suitable refrigerants.

The expansion device 226 may include an expansion valve positioned between and fluidly coupled to both the condenser 216 and the evaporator 228. In one embodiment, the expansion device 226 is located in the refrigerated space 220 or a location to cool air to be delivered to the refrigerated space 220. In another embodiment, the expansion device 226 is located outside of the refrigerated space 220 and is adjacent to or housed next to the condenser 216. Generally, the expansion device 226 reduces the pressure and temperature of the refrigerant outputted from the condenser 216, which is then fed to the evaporator 228. The expansion device 226 may be any conventional design and may have any suitable size, shape, configuration or capacity.

The evaporator 228 may be comprised of one or more evaporators that include one or more evaporator coils and one or more evaporator fans. In FIG. 3, the evaporator 228 is shown as being positioned within the refrigerated space 220. However, again, in some embodiments, the evaporator 228 may be adjacent to the refrigerated space 220 or in a manifold for cooling air to be delivered to the space. In operation, evaporator fans (not explicitly shown) draw air from the refrigerated space 220 over the evaporator coils to provide a heat exchange with the refrigerant flowing through the evaporator 128. The evaporator 228 may be any design and be any suitable size, shape, configuration or capacity.

Still referring primarily to FIG. 3, the compressor 230 may include one or more compressors. The compressor 230 is positioned between and fluidly coupled to both the evaporator 228 and the condenser 216. The compressor 230 compresses the refrigerant received from the evaporator 228 before the refrigerant is fed to the condenser 216. The compressor 230 acts on the refrigerant to increase the pressure of the refrigerant before the refrigerant is fed to the condenser 216. The compressor 230 may be any design and may be any suitable size, shape, configuration or capacity.

The condenser 216, which is housed in the condenser unit housing 202, may be a gas cooler or fluid cooler and may include one or more condenser coils, or tube-and-fin heat exchangers as described herein. In operation, the fan mounting assemblies, e.g., fans 108 in FIG. 1, pull in ambient air or cooling air or other fluid over the condenser coils of the condenser 216 to provide a heat exchange with the refrigerant flowing through the condenser 216 to cool the refrigerant. The fan mounting assemblies 108 then discharge air out of the condenser unit housing 202 (see arrows 112 in FIG. 1). The condenser 216 may be any design and may have any suitable size, shape, configuration or capacity, but includes one or more of the fin-and-tube heat exchangers described herein. It should be noted that the embodiments herein may be used with any coil system and could be used anywhere fin-tube coils are applied, including non-compressorized applications of coils. Any fin-tube coil could the concepts herein regardless of the system within which it is applied.

As previously noted, as an aspect of the tube-and-fin heat exchangers herein for use with refrigeration systems such as that just presented, the spacing and appearance of fins on the coil face of the heat exchanger appears to be in conformity with prior systems or legacy systems, but in fact additional fin elements, or embedded fins, are use used between each regular fin or at least many of the regular fins as will now be described in more detail.

Figure 4:
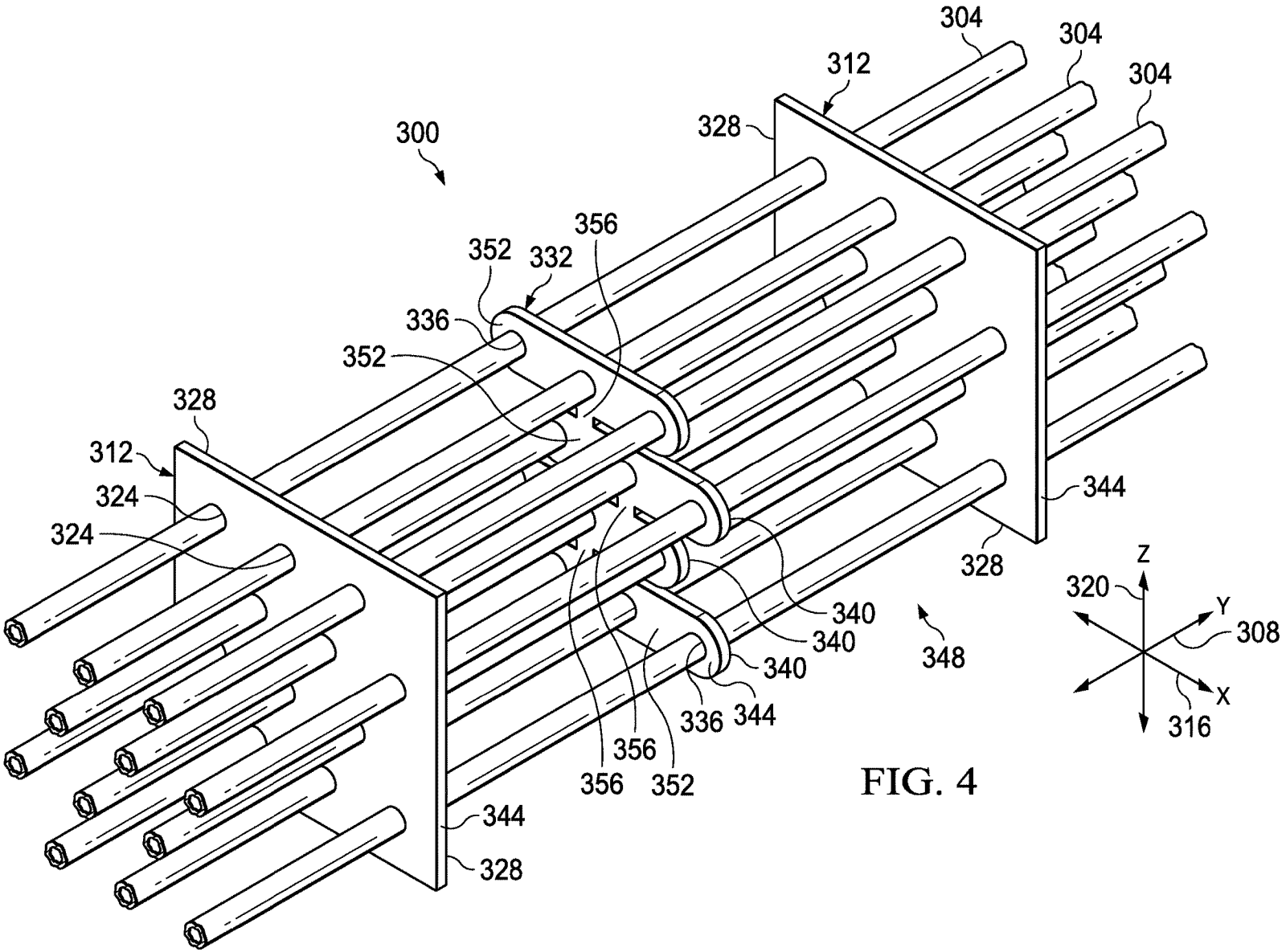
FIG. 4 is a schematic perspective view of a portion of a tube-and-fin heat exchanger according to an illustrative embodiment.

Referring now primarily to FIG. 4, a schematic perspective view of a portion of a tube-and-fin heat exchanger 300 is presented. The tube-and-fin heat exchanger 300 includes a plurality of tubes 304 that extend in a first direction, parallel to a y-axis 308. A plurality of fins 312 comprise, in one illustrative embodiment, thin sheets of metal that are placed on the tubes 304 substantially perpendicularly to the plurality of tubes 304. Each fin of the plurality of fins 312 extends in a direction parallel to an x-axis 316 and in a direction parallel to a z-axis 320. The fins 312 also have some thickness in the y direction 308. The fins 312 are formed with a plurality of apertures 324. The plurality of apertures 324 are sized and configured to receive the plurality of tubes 304. The fins 312 have an outer peripheral edge 328. The fins 312 may be substantially flat, square or rectangular members having some thickness (y direction 308). Those skilled in the art will appreciate that other shapes may be used for the fins 312.

Figure 5:
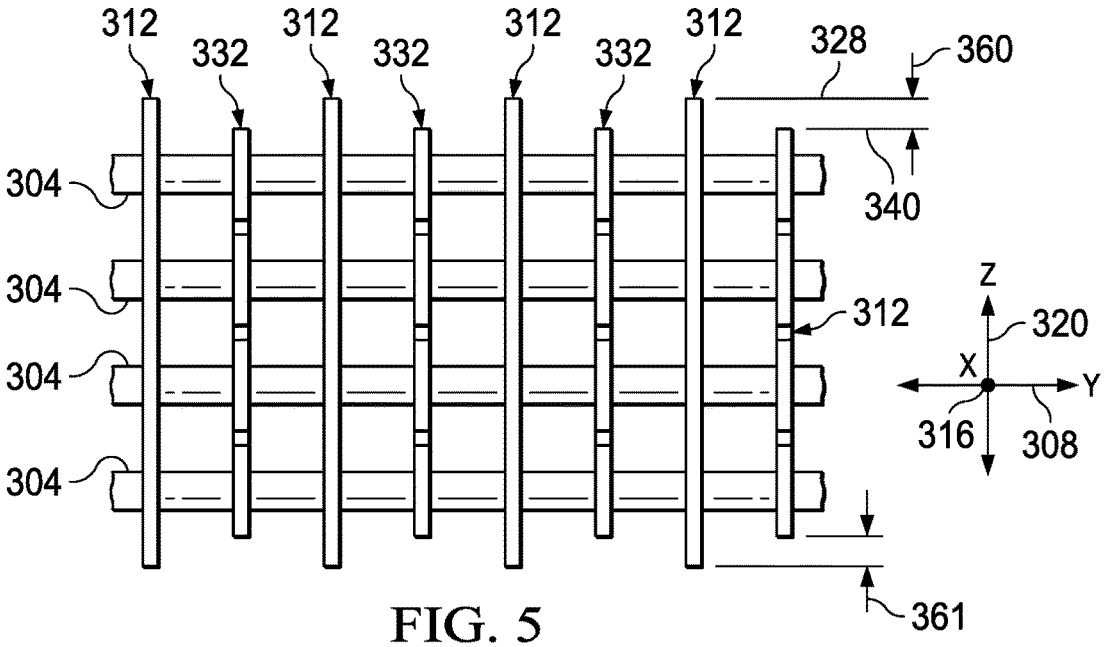
FIG. 5 is schematic side elevation view of a portion of the tube-and-fin heat exchanger of FIG. 4.

In between or in a spaced relationship with the plurality of fins 312, which also may be referred to as "normal fins," is a plurality of embedded fins 332 (only one is explicitly shown in FIG. 4 but see FIG. 5 for one pattern). Each of the embedded fins 332 is formed with a plurality of apertures 336 sized and configured to receive the plurality of tubes 304. The embedded fins 332 may take many shapes (see, e.g., FIGS. 6, 7, 8), and in each instance, an outer peripheral edge 340 of the plurality of embedded fins 332 is inboard of an outer peripheral edge 328 of the plurality of fins 312. The outer peripheral edge 340 of the plurality of embedded fins 332 is inboard of the outer peripheral edge 328 of the plurality of fins 312 by at least an offset distance (e.g., 360 and 361 in FIG. 5).

The offset distance may be at least 5% of a lateral width (e.g., width in x direction 316; 354 in FIG. 6) of the plurality of fins 312, or may be 10% or 15% of the lateral width or another dimension. The offset distance from the face may be related to the tube spacing; in some embodiments, ¼ of the tube spacing is used as the offset from each side—essentially removing half of the material from the coil edge to the nearest tube. In some embodiments, the outer periphery 340 is determined for non-uniform shapes by tracing along the outer edge of the embedded fins 332 and identifying the closest points to the outer periphery 328 of the fins 312 and taking the smallest value. In some embodiments, the off set is ¼ of an inch. In some embodiments, the offset is 1/10 of an inch. Other dimensions may be used.

A face 344, or coil face, of the tube-and-fin heat exchanger 300 thus has a greater space 348 between fin members at the outer peripheral edge 328 than would exist if the embedded fins 332 went out to the coil face 344 like the regular fins 312. This space may decrease fouling at the face 344 or at a minimum give comfort to users that fouling is less likely to occur. At the same time, the addition of the plurality of embedded fins 332 adds considerable heat transfer surfaces to the heat exchanger 300 and thereby increases heat transfer efficacy. As such, a smaller heat exchanger 300 may be used in some applications than would otherwise be possible.

In some embodiments, the plurality of embedded fins 332 and the plurality of fins 312 are coupled to the plurality of tubes 304 to establish a fin pattern having alternating fins 312 and embedded fins 332. In some embodiments, because of the offset distance, an observer six feet away will see mainly just the fins 312 and will not perceive the embedded fins 332 as fins.

The embedded fins 332 may take many forms as will be further explained. In FIG. 4, the embedded fin 332 comprises a plurality of longitudinal members 352, or oblong rows, formed as unitary whole by tab connections 356 between adjacent longitudinal members 352. In at least some embodiments, when in an assembled position, the plurality of longitudinal members 352 is substantially perpendicular to the plurality of tubes 304, i.e., the tubes 304 run in the y direction 308 and the longitudinal members 352 run in the x direction 316. Other shapes are presented further below in connection with FIGS. 6-11. The embedded fins 332 and fins 312 may be made from metal or other heat-conducting materials as those skilled in the art would understand.

Referring now primarily to FIG. 5, a schematic diagram in side elevation of a portion of the tube-and-fin heat exchanger 300 of FIG. 4 is presented. In this view, one may see an alternating pattern between the plurality of fins 312 and the embedded fins 332 as they are attached to the plurality of tubes 304. This view also shows an example of an offset distance 360 between the outer periphery 328 of the fins 312 and the outer periphery 340 of the embedded fins 332.

The plurality of fins 312 is coupled to the plurality of tubes 304 such that a desired fins per inch (FPI) measure is realized. In some embodiments, the FPI may range from 2 FPI to 26 FPI or more. In some embodiments, 10 FPI or less is used, and wherein the plurality of embedded fins 332 is coupled to the plurality of tubes 304 such that a fins per inch measure is 10 fins per inch or less. An observer from a six feet away or so would perceive the fin member density to be 10 fins per inch, but when counting both the plurality of fins 312 and the embedded fins 332, the fins per inch would be higher, e.g., 20 fins per inch, and the functional performance would be the equivalent of have an extended number of normal fins. For example, if the heat exchanger has 10 FPI of fins 312 and 10 FPI of embedded fins 332, the functional equivalent of all normal fins 312 might be 16 or 17 FPI. It will be appreciated by those skilled in the art that many different FPI measures may be used in different embodiments.

Figure 6:
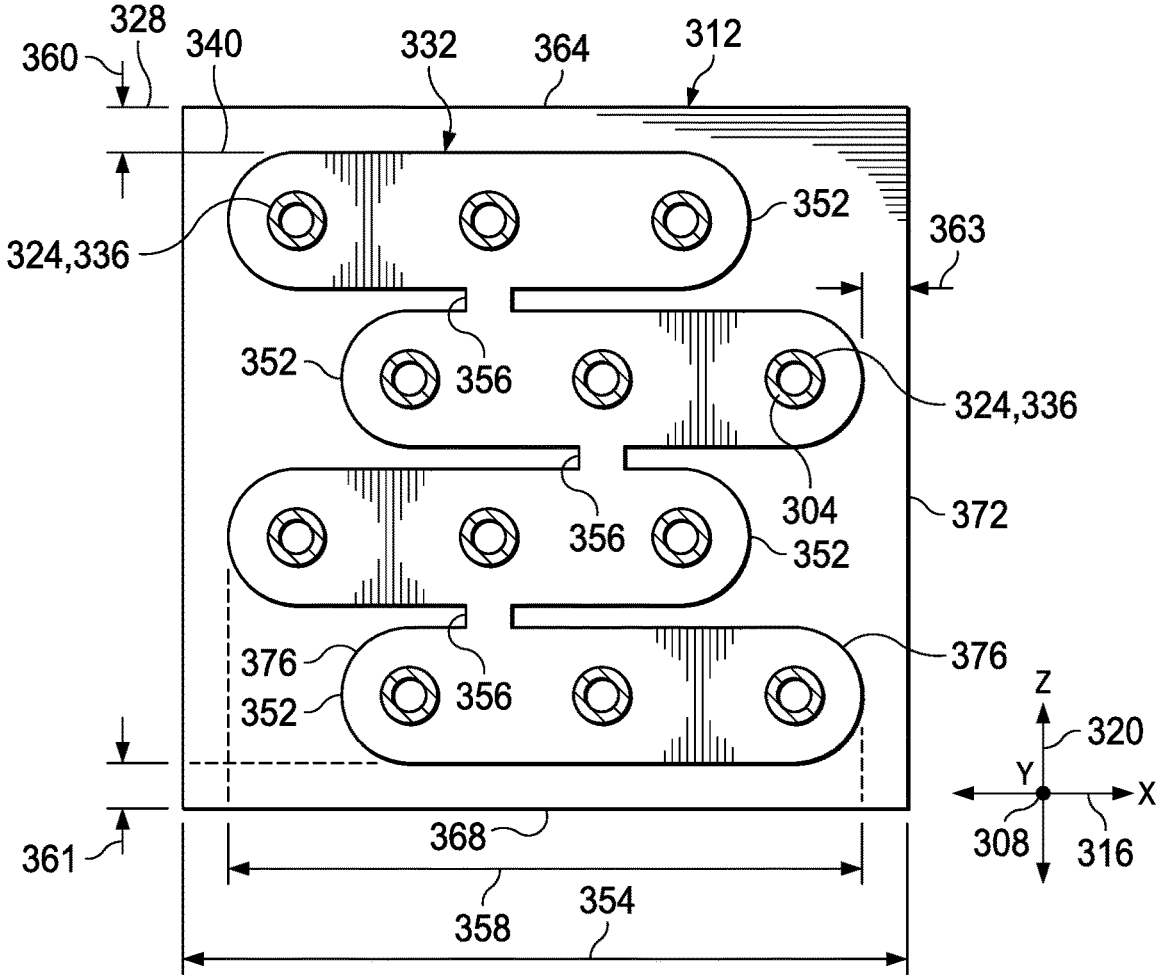
FIG. 6 is a schematic end elevation view of a portion of the tube-and-fin heat exchanger FIGS. 4 and 5.

Referring now primarily to FIG. 6, a schematic end elevation view of a portion of the tube-and-fin heat exchanger 300 of FIGS. 4 and 5 is presented. This view is taken from the right side of FIG. 5 and clearly shows the offset distances 360, 361; each is taken between the outer periphery 328 of the fins 312 and the closest sustained outer periphery 340 of the embedded fins 332. Similarly, perpendicular to offset 360, the offset 363 is shown. The offset distance 360 may be measured between the outer periphery 328 of the fins 312 and the closest sustained outer periphery 340—at least from the top edge 364, bottom edge 368, and side edge 372, and the closest (smallest) measurement will be deemed to be the offset distance 360 for purposes here.

FIG. 6 also shows the shape of one of the plurality of embedded fins 332. In this illustrative embodiment, the embedded fin 332 is formed from the plurality of longitudinal members 352, or oblong members, running in the x direction 316 having ends 376 that are rounded and that are coupled by the tab connections 356 on an interior portion of the members 352 that make a unitary whole. This facilitates manufacturing and lowers the part count. This view also shows the apertures 324, 336 formed in the fins 312 and embedded fins 332, respectively, through which the tubes 304 extend. The attachment of the fins 312, 332 to the tubes 304 is by interference fit, welds, brazen connections, bonds, or other attachment techniques.

Figure 7:
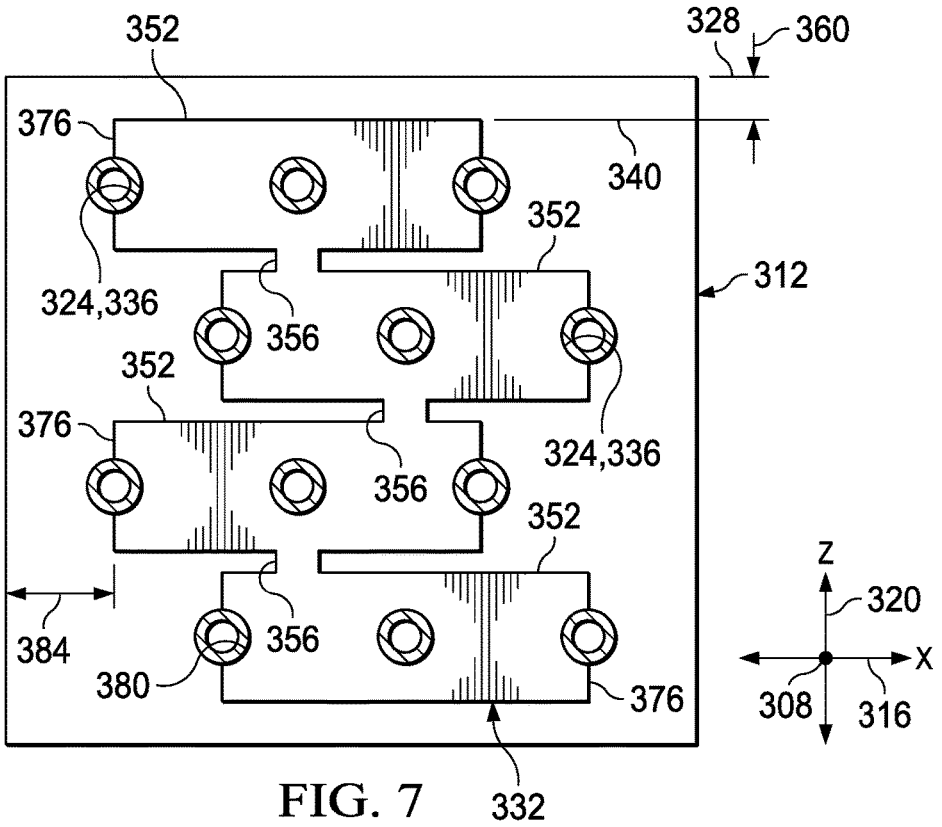
FIG. 7 is a schematic end elevation view of a portion of a tube-and-fin heat exchanger according to an illustrative embodiment.

Referring now primarily to FIG. 7, a schematic end elevation view of a portion of a tube-and-fin heat exchanger is presented that is analogous to the tube-and-fin heat exchanger 300 in FIG. 6 in most respects, except the shape of the visible embedded fin 332 is slightly different at the ends. In this illustrative embodiment, each embedded fin 332 is formed from the plurality of longitudinal members 352 running in the x direction 316 but having square ends 376. The longitudinal members 352 are coupled by the tab connections 356 on an interior portion of the members 32 to make a unitary whole. In addition, the ends 376 of the longitudinal members 352 have partial apertures 380 that help bring the average offset 384 for the outer periphery 340 of the embedded fin 332 in the x direction 316 further inboard, that is makes it bigger. This half apertures may also be used at the top and bottom (for orientation shown) to make the offset bigger in the z direction 320.

Figure 8:
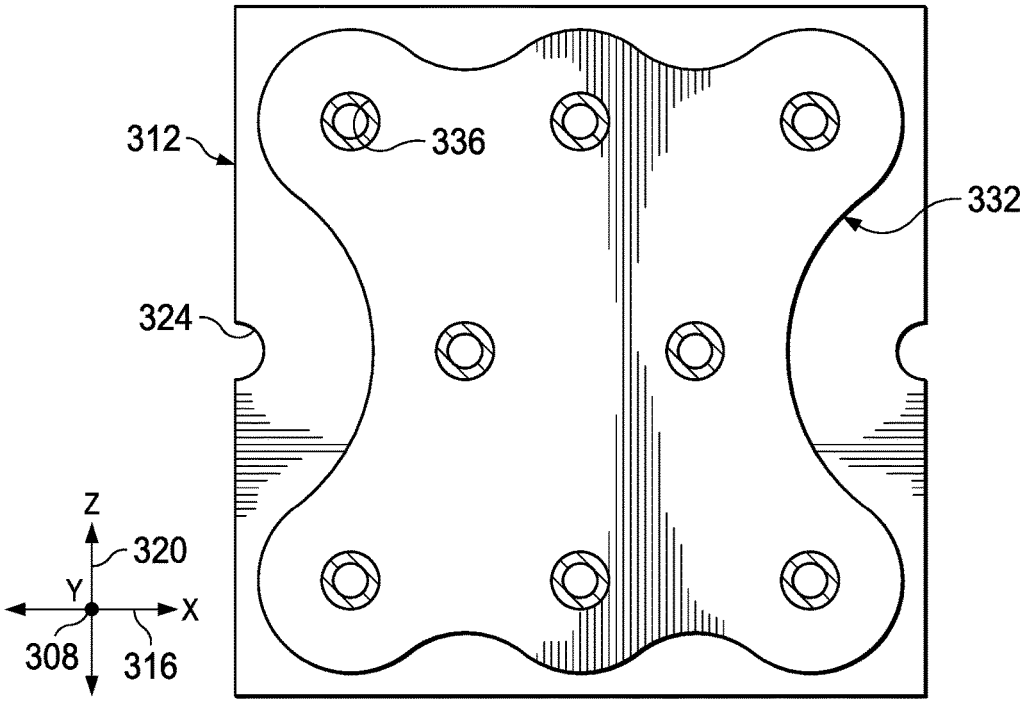
FIG. 8 is a schematic end elevation view of a portion of a tube-and-fin heat exchanger according to an illustrative embodiment.

Referring now primarily to FIG. 8, a schematic end elevation view of a portion of a tube-and-fin heat exchanger that is analogous in most respects to the tube-and-fin heat exchanger 300 in FIG. 6, except the shape of the visible embedded fin 332 is different. The embedded fin 332 is shaped as a solid member, or plate member, that surrounds the apertures 336, e.g., eight of them in the figure. The shape is formed by providing a certain amount of material around each aperture 336 and providing additional material that couples them all into one piece, or formed so the shape of embedded fin has the material nearest the coil face cut away, but otherwise is formed with a solid surface.

Figure 9:
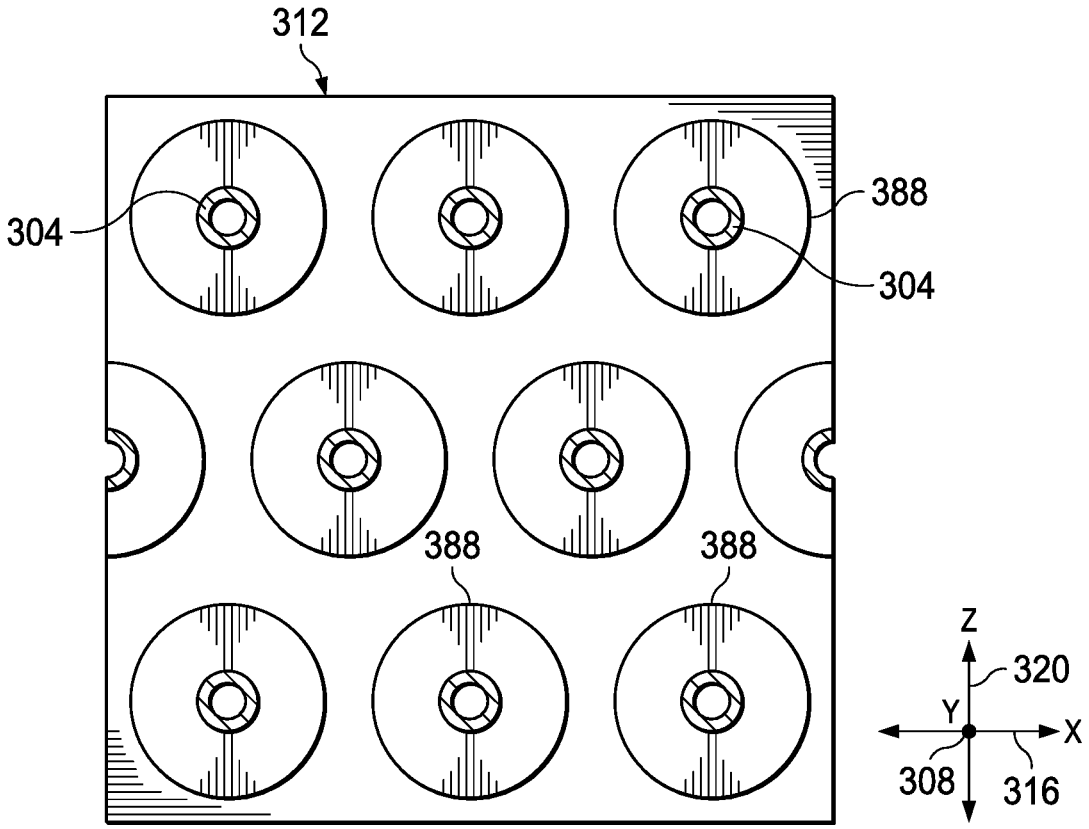
FIG. 9 is a schematic end elevation view of a portion of a tube-and-fin heat exchanger showing disc fin members according to an illustrative embodiment.
Figure 10:
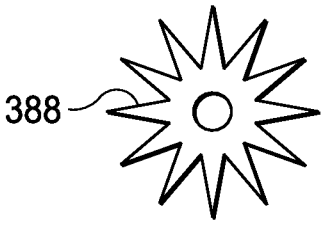
FIG. 10 is a schematic end elevation view of a disc fin shaped like a star.
Figure 11:
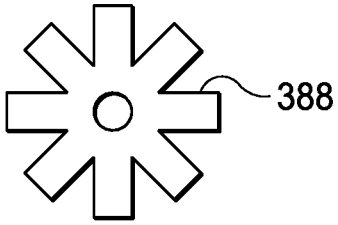
FIG. 11 is a schematic end elevation view of a disc fin shaped like a columned wheel.

Referring now primarily to FIG. 9, a schematic end elevation view of a portion of a tube-and-fin heat exchanger that is analogous in most respects to the tube-and-fin heat exchanger 300 in FIG. 6, except that instead of a unitary embedded fin, a plurality of disc fin members 388, or round plate fins, are used as the embedded fin to provide additional heat transfer. The disc fins 388 in FIG. 9 are circular, but could take other shapes, such sun star shaped (FIG. 10) or a column wheel (FIG. 11) or many other shapes.

Referring now primarily to FIGS. 1-5, according to one illustrative embodiment, a refrigeration system 200 includes a compressor 230 and a condenser 216, which is fluidly coupled to the compressor 230. The refrigeration system 200 further includes an expansion valve 226 fluidly coupled to the condenser 216 and includes an evaporator 228 fluidly coupled to the expansion valve 226. The compressor 230, the condenser 216, the expansion valve 226, and the evaporator 228 form a closed fluid path 222 for a refrigerant to flow.

The condenser 216 includes a tube-and-fin heat exchanger 300 having a plurality of tubes 304 for receiving a refrigerant from the compressor 230 and a plurality of fins 312 coupled to the plurality of tubes 304 and having an outer peripheral edge 328. The condenser further includes a plurality of embedded fins 332 coupled to the plurality of tubes 304 and having an outer peripheral edge 340. The outer peripheral edge 340 of the plurality of embedded fins 332 is inboard of the outer peripheral edge 328 of the plurality of fins 312. The fins 312 and embedded fins 332 may alternate or be in any varied pattern, e.g., F, EF, F, EF, F . . . ; or F, F, EF, F, F, EF, F, F, . . . ; etc. In other illustrative embodiment, this type of tube-and-fin heat exchanger 300 is used in the evaporator.

According to an illustrative embodiment, a method of manufacturing a tube-and-fin heat exchanger 300 for use in a refrigeration system 200 includes: providing a plurality of fins 312 having a lateral width W1 354 and having a first plurality of apertures 324; providing a plurality of embedded fins 332 having a lateral width W2 358 (FIG. 6) W2 is less than 95% to 85% of W1. The embedded fins 332 have a second plurality of apertures 336. The method further includes providing a plurality of tubes 304. The first plurality of apertures 324 and second plurality of apertures 336 are sized and configured to have the plurality of tubes 304 inserted into the first plurality of apertures 324 and the second plurality of apertures 336. The tubes 304 are inserted into the apertures 324, 336. The method may also involve attaching the plurality of fin 312 and the plurality of embedded fin 332 in an alternating fashion on the tubes 304.

According to an illustrative embodiment, a tube-and-fin heat exchanger has spaced fins that extend to an outer periphery of the heat exchanger and has smaller (less area) embedded fins in between each of the other fins or according to a pattern. The embedded fins do not extend all the way to the outer periphery of the fins but have a shorter outer periphery such that there is an offset distance. Because of the offset distance, there is space that continues to provide room for fluid movement without fouling of the coil face of the heat exchanger and provides an expected appearance while still having the benefit of additional fins further inside of the heat exchanger. The smaller embedded fins may take the shape of long members that are connected together to form a single piece for ease of manufacture, a plate, or individual discs of various possible shapes.

Figure 12:
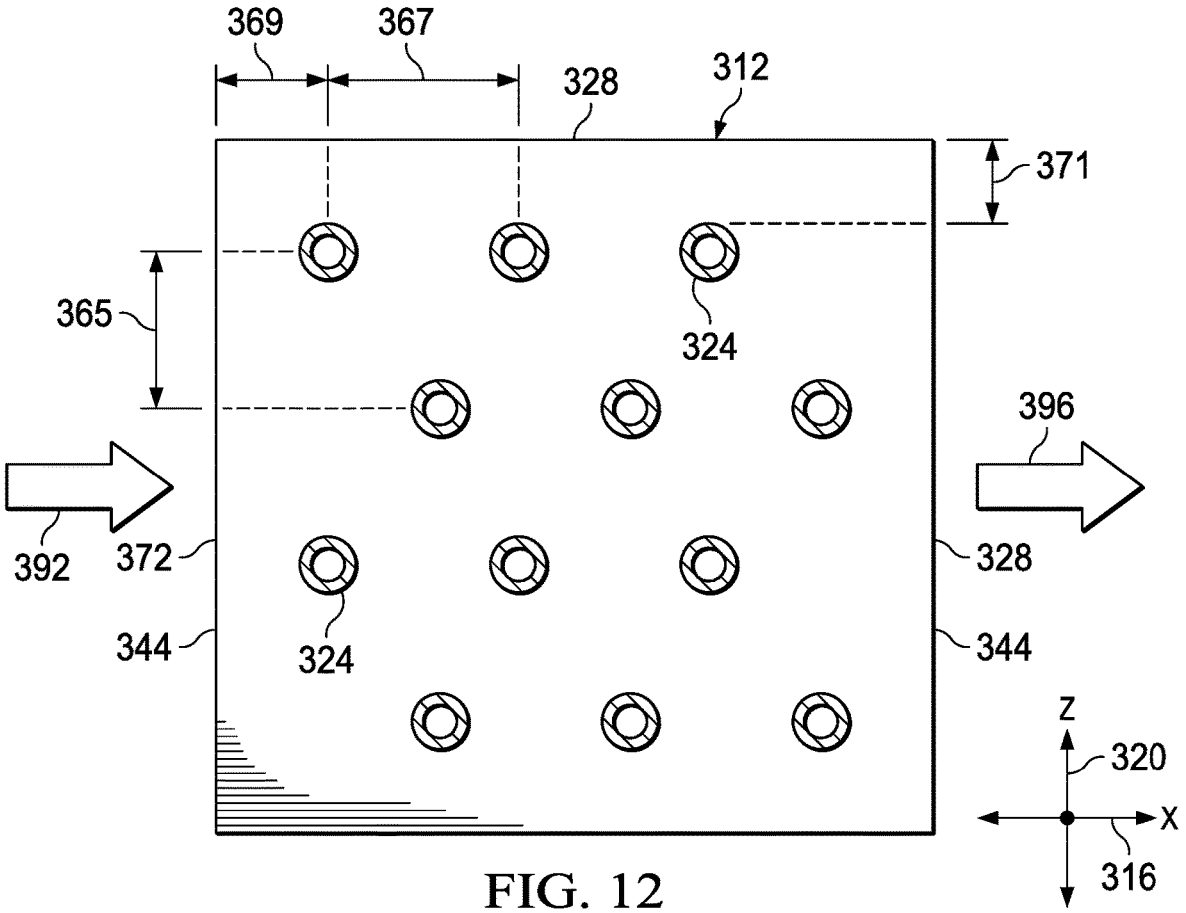
FIG. 12 is a schematic end view of a regular fin with certain dimensions noted.

Referring now primarily to FIG. 12, one fin of the plurality of fins 312 of the tube-and-fin heat exchanger 300 is shown in an end view. The fin 312 is shown with apertures 324 to accommodate tubes 304 (FIG. 2). One illustrative embodiment of aperture 324 spacing is shown. The apertures 324 are spaced from one another in the vertical (for the orientation shown) by distance 365 and in the horizontal by a distance 367. The fin slitter cuts, or formation cuts, are made between the apertures in each direction on the ends and so the horizontal offset from the peripheral edge 344 is distance 369 and the vertical offset from the peripheral edge 344 is distance 371. In some embodiments, the offset is ¼ of the regular tube spacing from the edge 344. For example, if in one illustrative embodiment, the horizontal spacing 367 is 1.7 inches, then the offset 369 from the vertical peripheral edge 344 would be half of that or 0.85 inches. If the vertical tube spacing 365 is 2 inches, the vertical offset 371 from the peripheral edge 344 would be 1 inch. In this illustration, the airflow is shown by arrows 392 and 396. An "airside direction" would mean from a side edge 372 that faces the airflow 392 (inlet) or the airflow 396 (outlet).

Figure 13:
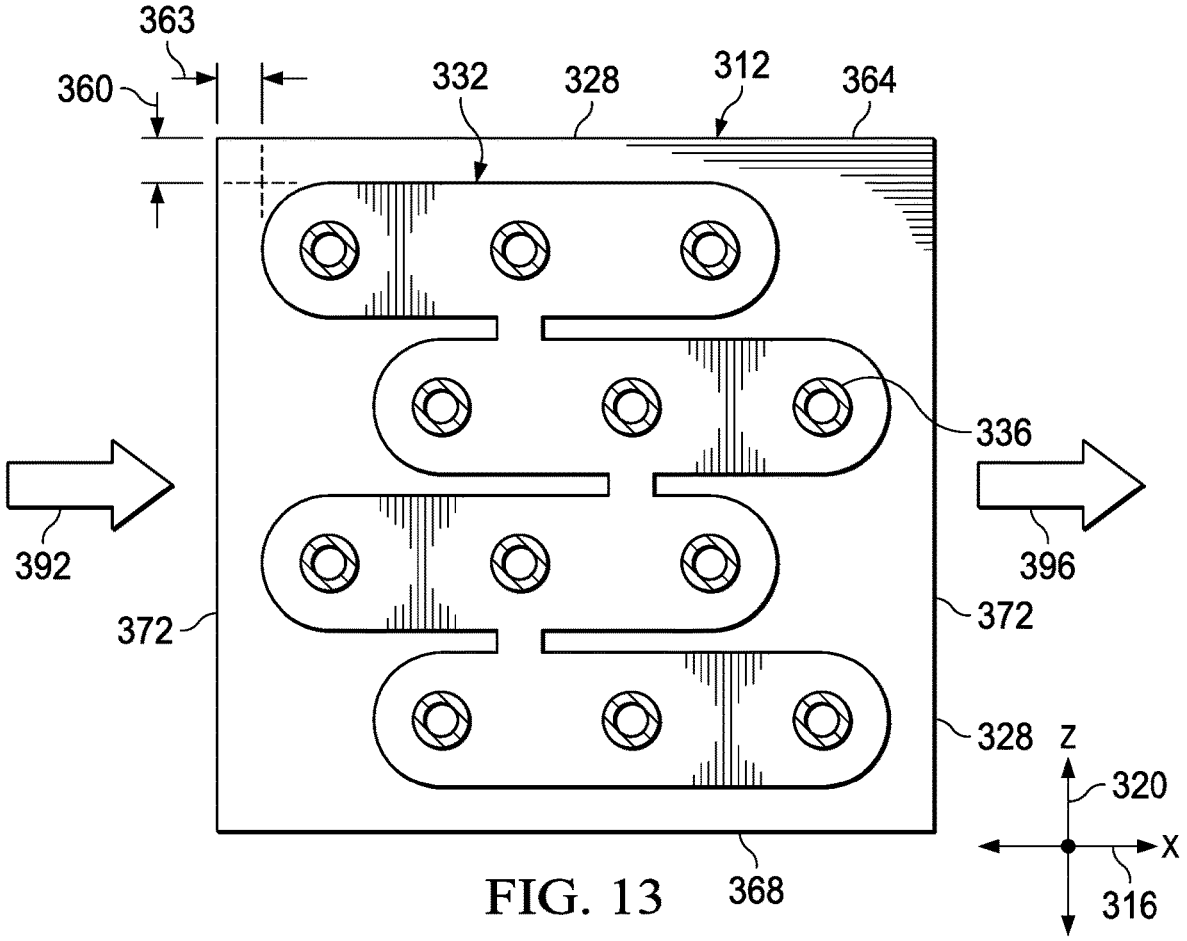
FIG. 13 is a schematic end elevation view of a portion of the tube-and-fin heat exchanger with an embedded fin in front of a regular fin and with certain dimensions notes.

Referring now primarily to FIG. 13, an embedded fin 332 and a regular fin 312 as part of the tube-and-fin heat exchanger 300 are shown from an end view. This shows the offset spacing 360 from a top edge 364 and offset spacing 363 from the side edge. This view is presented to contrast with FIG. 14. In one embodiment, the offset 360 from the top edge is 0.5 inches, and the offset 363 from the side edge 372 is 0.425 inches. These are ¼ of the tube spacing; e.g., 1.7/4 is 0.425 and likewise ⅔ is 0.5 inches. While ¼ of the tube spacing may be used, other spacing intervals may be used, e.g., ⅓ or ⅛.

Without being limited to theory, it may be that the offset from the side edges 372 are the only offsets that are need, and doing away with the offset from the top edge 364 and bottom edge 368 may allow more material to be included in the embedded fin 332. That in turn may further enhance performance of the embedded fin 332. That leads to FIG. 14.

Figure 14:
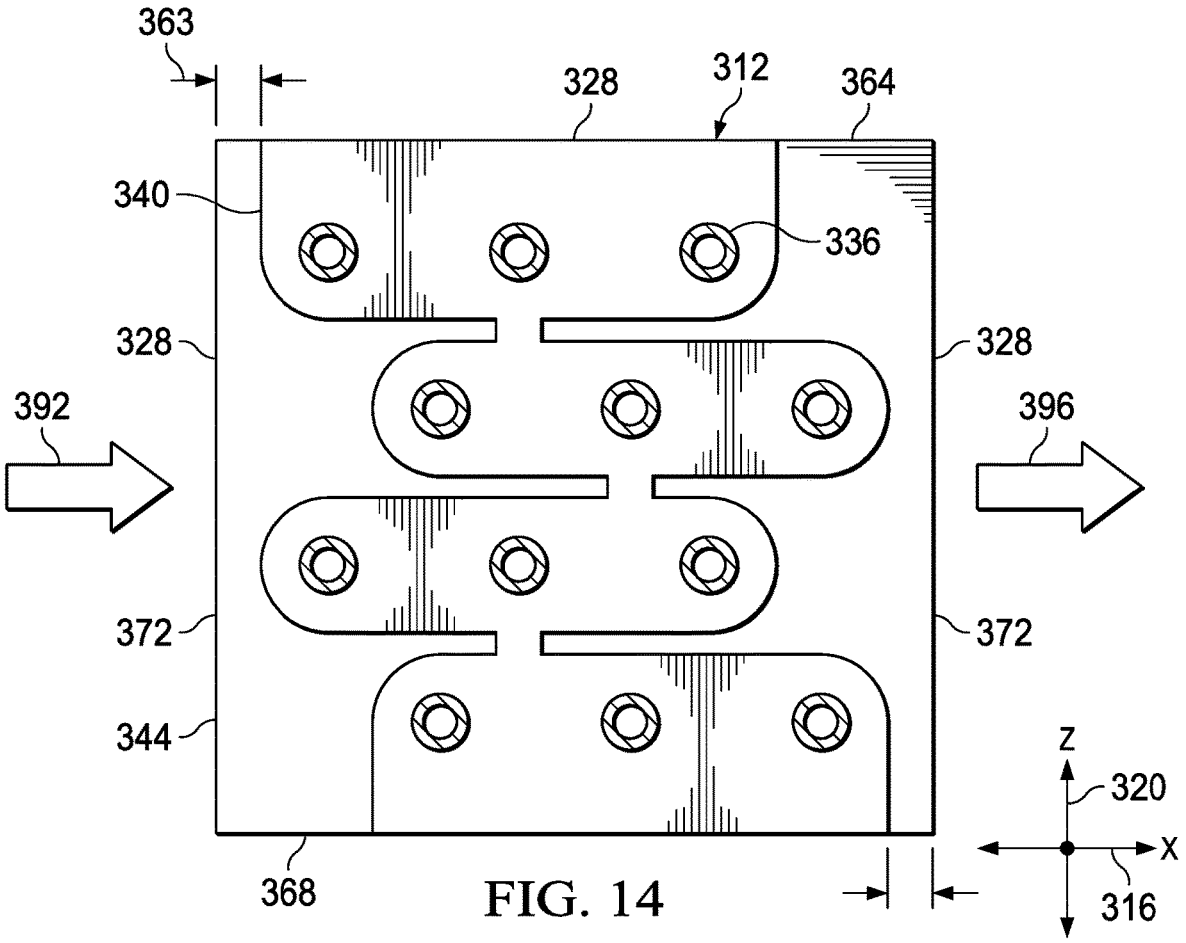
FIG. 14 is a schematic end elevation view of a portion of the tube-and-fin heat exchanger with the embedded fin only embedded at the edges perpendicular to the airflow.

FIG. 14 shows an alternative embodiment of an embedded fin 332 and a regular fin 312 as part of the tube-and-fin heat exchanger 300. In this embodiment, the offset from the top edge 364 and bottom edge 368 are taken to zero. In other words, the embedded fin 332 goes to the outer peripheral edge 328 on the top edge 364 and bottom edge 368. The embedded fin 332 is, however, offset from the outer peripheral edge 328 on the side edges 372, i.e., from the airside direction. The side edges 372 are perpendicular to the airflow 392, 396 or gas flow. So this provides the spacing on the airflow edges or airside direction while maximizing material in the directions of the top and bottom.

According to an illustrative embodiment, a tube-and-fin heat exchanger includes additional fin area (from embedded fins) while maintaining apparent fin density at the coil face to allay concerns about contaminants clogging the coil over time. In one embodiment, fin segments are added that do not extend to the face of the coil. These fin segment add fin surface area without adding density at the coil face. The fin segments may be connected by a small amount of material to reduce part count or may be individual pieces. The spacing of usual fin (with half the collar height) remains the same with fin segments (with half the collar height) between so that the apparent fin spacing at the coil face remains the same. In one embodiment, on the high side of a refrigeration system, the apparent fins per inch at the face of the coil is maintained at 10 FPI or less but the actual fin density (counting fin elements of both fins 312 and embedded fins 332) is higher further into the coil, e.g., 20 FPI, for a functional FPI equivalent just using regular fins of 16 or 17 FPI. Again, various FPIs could be used as one skilled in the art would understand. In one embodiment on the low side of a refrigeration system, the same arrangement may be used on the heat exchanger to provide more fin area without increasing frost on the low-side coils. Moreover, hot-gas defrost would be more effective.

In some embodiments, the fin segments, or embedded fins, may be enhanced with additional corrugations, cuts, or edge effects.

The tube-and-fin heat exchangers herein may be used with conventional refrigeration systems or non-conventional cooling systems or other applications involving tube-and-fin heat exchangers. The tube-and-fin heat exchangers herein may be used in a wide variety of refrigeration and heating, ventilation, and air conditioning applications—generally referenced as cooling systems at times.

Unless otherwise specified, any use of any form of the terms "connect," "engage," "couple," "attach," or any other term describing an interaction between elements is not meant to limit the interaction to direct interaction between the elements and may also include indirect interaction between the elements described. Coupled in some instances may refer to fluid coupling. In the discussion herein and in the claims, the terms "including" and "comprising" are used in an open-ended fashion, and thus should be interpreted to mean "including, but not limited to . . . ."

It will be understood that the benefits and advantages described above may relate to one embodiment or may relate to several embodiments. It will further be understood that reference to "an" item refers to one or more of those items.

The steps of the methods described herein may be carried out in any suitable order, or simultaneously where appropriate.

In the detailed description of the preferred embodiments herein, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The detailed description herein is, therefore, not to be taken in a limiting sense, and the scope of the present invention is defined only by the claims.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. A refrigeration system comprising:
a compressor;
a condenser fluidly coupled to the compressor;
an expansion valve fluidly coupled to the condenser;
an evaporator fluidly coupled to the expansion valve;
wherein the compressor, the condenser, the expansion valve, and the evaporator comprise a closed fluid path for moving a refrigerant; and
wherein the condenser comprises:
a plurality of tubes for receiving the refrigerant from the compressor,
a plurality of fins coupled to the plurality of tubes and having an outer peripheral edge,
a plurality of embedded fins coupled to the plurality of tubes and having an outer peripheral edge,
wherein the outer peripheral edge of the plurality of embedded fins is inboard of the outer peripheral edge of the plurality of fins on at least two sides and at least from an airside direction, and
the plurality of tubes extends through both the plurality of fins and the plurality of embedded fins.

2. The refrigeration system of claim 1, wherein the outer peripheral edge of the plurality of embedded fins is inboard of the outer peripheral edge of the plurality of fins by at least 5% of a lateral width of the plurality of fins.

3. The refrigeration system of claim 1, wherein the outer peripheral edge of the plurality of embedded fins is inboard of the outer peripheral edge of the plurality of fins by at least one inch.

4. The refrigeration system of claim 1, wherein the outer peripheral edge of the plurality of embedded fins is inboard of the outer peripheral edge of the plurality of fins by at least 1/4 of a distance between tubes.

5. The refrigeration system of claim 1, wherein each of the plurality of tubes extends through both the plurality of fins and the plurality of embedded fins.

6. The refrigeration system of claim 1, wherein the plurality of embedded fins and the plurality of fins are coupled to the plurality of tubes so as to establish a fin pattern having alternating fins and embedded fins.

7. The refrigeration system of claim 1, wherein each of the embedded fins comprises a plurality of longitudinal members coupled by a tab member between each that forms a space between each and having a plurality of apertures through each longitudinal member for receiving tubes.

8. The refrigeration system of claim 1, wherein each of the embedded fins comprises a plurality of longitudinal metal members formed as unitary whole by tab connections between adjacent longitudinal members, and, when in an assembled position, the plurality of longitudinal metal members is perpendicular to the plurality of tubes.

9. The refrigeration system of claim 1, wherein each of the embedded fins comprises a solid, integral plate member without cutouts or tabs having a plurality of apertures through the solid, integral plate member for receiving the plurality of tubes.

10. The refrigeration system of claim 1, wherein the plurality of embedded fins comprises a plurality of disc fins, each having an aperture through which a tube of the plurality of tubes enters.

11. The refrigeration system of claim 1, wherein the plurality of embedded fins comprises a plurality of disc fins, each having an aperture through which a tube of the plurality of tubes enters and wherein each disc fin of the plurality of disc fins is shaped like a star.

12. The refrigeration system of claim 1, wherein:

the outer peripheral edge of the plurality of embedded fins is inboard of the outer peripheral edge of the plurality of fins by at least 1/4 of a distance between tubes; and the plurality of embedded fins and the plurality of fins are coupled to the plurality of tubes so as to establish a fin pattern having alternating fins and embedded fins.

13. The refrigeration system of claim 12, wherein the outer peripheral edge of the plurality of embedded fins are inboard of the outer peripheral edge of the plurality of fins at least 1/10 of an inch.

14. The refrigeration system of claim 1, wherein the outer peripheral edge of the plurality of embedded fins is offset from the outer peripheral edge of the plurality of fins with respect to an a top edge, which is perpendicular to a direction of airflow, but not offset along side edges parallel to the direction of airflow.

15. A tube-and-fin heat exchanger, the tube-and-fin heat exchanger comprising:

a plurality of tubes;

a plurality of fins coupled perpendicularly to the plurality of tubes and having an outer peripheral edge;

a plurality of embedded fins coupled substantially perpendicularly to the plurality of tubes and having an outer peripheral edge;

wherein the outer peripheral edge of the plurality of embedded fins is inboard of the outer peripheral edge of the plurality of fins at least from the outer peripheral edge of the plurality of fins proximate two side edges; and wherein the plurality of tubes extends through the plurality of fins and the plurality of embedded fins.

16. The tube-and-fin heat exchanger of claim 15, wherein each of the plurality of tubes extends through both the plurality of fins and the plurality of embedded fins.

17. The tube-and-fin heat exchanger of claim 15, wherein the outer peripheral edge of the plurality of embedded fins is inboard of the outer peripheral edge of the plurality of fins by at least 5% of a lateral width of the plurality of fins.

18. The tube-and-fin heat exchanger of claim 15, wherein the outer peripheral edge of the plurality of embedded fins is inboard of the outer peripheral edge of the plurality of fins by at least 10% of a lateral width of the plurality of fins.

19. The tube-and-fin heat exchanger of claim 15, wherein the plurality of embedded fins and the plurality of fins are coupled to the plurality of tubes such as to establish a fin pattern having alternating fins and embedded fins.

20. The tube-and-fin heat exchanger of claim 15, wherein the outer peripheral edge of the plurality of embedded fins is inboard of the outer peripheral edge of the plurality of fins by at least 1/4 of the distance between tubes.

21. A refrigeration system comprising:

a compressor;

a condenser fluidly coupled to the compressor;

an expansion valve fluidly coupled to the condenser;

an evaporator fluidly coupled to the expansion valve;

wherein the compressor, the condenser, the expansion valve, and the evaporator comprise a closed fluid path for moving a refrigerant; and wherein the condenser comprises:

a plurality of tubes for receiving the refrigerant from the compressor, a plurality of fins coupled to the plurality of tubes and having an outer peripheral edge, a plurality of embedded fins coupled to the plurality of tubes and having an outer peripheral edge, wherein the outer peripheral edge of the plurality of embedded fins is inboard of the outer peripheral edge of the plurality of fins at least from an airside direction, and wherein each of the embedded fins comprises a plurality of longitudinal members coupled by a tab member between each that forms a space between each and having a plurality of apertures through each longitudinal member for receiving tubes.

* * * * *